US007986203B2

(12) United States Patent
Watford

(10) Patent No.: US 7,986,203 B2
(45) Date of Patent: Jul. 26, 2011

(54) MULTI-POLE ARMATURE INTERLOCK FOR CIRCUIT BREAKERS

(75) Inventor: Russell T. Watford, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 422 days.

(21) Appl. No.: 12/370,676

(22) Filed: Feb. 13, 2009

(65) Prior Publication Data

US 2009/0205941 A1 Aug. 20, 2009

Related U.S. Application Data

(60) Provisional application No. 61/029,595, filed on Feb. 19, 2008.

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 3/00*** | (2006.01) |
| ***H01H 67/06*** | (2006.01) |
| ***H01H 25/00*** | (2006.01) |

(52) U.S. Cl. ..... 335/10; 335/6; 335/8; 335/15; 335/21; 335/22; 335/23; 335/35; 335/68; 335/102; 335/106; 335/127; 335/172; 335/174; 335/185; 200/337

(58) Field of Classification Search ..... 335/1–2, 335/6–10, 15–16, 21–23, 34–38, 68, 99, 335/102, 106, 127–128, 172–174, 185–186, 335/189; 200/337

See application file for complete search history.

(56) References Cited

U.S. PATENT DOCUMENTS

| | | | | |
|---|---|---|---|---|
| 1,633,833 | A * | 6/1927 | Townsend | 335/128 |
| 1,742,109 | A * | 12/1929 | Weber | 335/127 |
| 4,079,345 | A * | 3/1978 | Pietsch | 335/10 |
| 4,342,974 | A * | 8/1982 | Nakano et al. | 335/10 |
| 4,586,011 | A * | 4/1986 | Mostosi | 335/6 |
| 4,606,589 | A | 8/1986 | Elsbree, Jr. | |
| 5,260,676 | A * | 11/1993 | Patel et al. | 335/18 |
| 5,701,110 | A | 12/1997 | Scheel | |
| 6,218,917 | B1 * | 4/2001 | Criniti et al. | 335/35 |
| 6,946,935 | B2 * | 9/2005 | Wu et al. | 335/18 |
| 2003/0137373 | A1 * | 7/2003 | Grumel et al. | 335/68 |
| 2004/0032702 | A1 | 2/2004 | Gibson | |
| 2006/0097829 | A1 * | 5/2006 | McCoy | 335/6 |

FOREIGN PATENT DOCUMENTS

| | | | |
|---|---|---|---|
| DE | 9421647 | U1 | 5/1996 |
| EP | 0830702 | B1 | 3/2002 |
| EP | 1381067 | A2 | 1/2004 |
| JP | 02051819 | A * | 2/1990 |

* cited by examiner

*Primary Examiner* — Anh Mai
*Assistant Examiner* — Mohamad Musleh
(74) *Attorney, Agent, or Firm* — Jose R. de la Rosa

(57) ABSTRACT

A multi-pole circuit breaker and method include at least two breaker modules including circuit breakers therein. The circuit breakers include a moveable arm configured to connect and disconnect contacts therein. The at least two modules including armatures connectable to the moveable arms of each of the at least two modules. A center module connects the at least two modules. The center module includes an actuator and a beam connected to the actuator at a mid-portion. The beam connects to each armature of the at least two modules wherein under a trip condition the actuator displaces the beam to simultaneously trip the at least two modules using the armatures.

17 Claims, 7 Drawing Sheets

MULTI-POLE ARMATURE INTERLOCK FOR CIRCUIT BREAKERS

RELATED APPLICATION INFORMATION

This application claims priority to provisional application Ser. No. 61/029,595 filed on Feb. 19, 2008, incorporated herein by reference.

BACKGROUND

1. Technical Field

This disclosure relates to circuit breakers, and more particularly, to an apparatus and method for interlocking two or more circuit breaker pole armatures to coordinate breaker tripping events.

2. Description of the Related Art

In many multi-pole circuit breaker designs, a crossbar is used to interface with handles associated with each mechanism pole. The crossbar ties the handles together at a pivot point to ensure that all live conductors are interrupted when any pole trips in the multi-pole breaker. This is referred to as a "common trip" breaker, which ties the poles together via their operating handles.

Without a way to link the breakers together, one armature may trip independently of the other, and the other pole mechanism would then take on more current and thus delay the time to trip. This may cause damage to the circuit of the load for which the circuit breaker was to provide protection.

SUMMARY OF THE INVENTION

A multi-pole circuit breaker and method include at least two breaker modules including circuit breakers therein. The circuit breakers include a moveable arm configured to connect and disconnect contacts therein. The at least two modules include armatures connectable to the moveable arms of each of the at least two modules. A center module connects the at least two modules. The center module includes an actuator and a beam connected to the actuator at a mid-portion. The beam connects to each armature of the at least two modules wherein under a trip condition the actuator displaces the beam to simultaneously trip the at least two modules using the armatures.

A method for simultaneously tripping a multi-pole circuit breaker includes providing at least two breaker modules including circuit breakers therein, the circuit breakers including a moveable arm configured to connect and disconnect contacts therein, the at least two modules including armatures connectable to the moveable arms of each of the at least two modules; and a center module connecting the at least two modules, the center module including an actuator, and a beam connected to the actuator at a mid-portion, the beam connecting to each armature of the at least two modules beam. A trip condition is detected in at least one of the at least two breaker modules, and the actuator is energized under the trip condition to displace the beam to simultaneously trip the at least two modules using the armatures.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present principles provide a mechanical link of armatures of multiple pole current carrying devices. The multiple pole current carrying devices may include residential circuit breaker designs where two outer modules include thermal-magnetic operating mechanisms while a center module includes a magnetic solenoid that mechanically trips the outer poles simultaneously. Where applicable, a direct armature concept is applicable to other designs as well.

In accordance with the present principles, embodiments are provided to prevent individual poles of multi-pole devices from being tripped independently of one another. This provides a direct interface between the armatures and improves the robustness of multiple pole breaker designs by reducing the number of mechanical interfaces needed. An alternate approach is to employ a separate trip bar which interfaces with the magnetic solenoid with each end supported by outer walls of the breaker. This alternate concept needs tighter control of dimensional clearances/tolerances and may permit too much positional difference between the journals/solenoid/armatures of each pole.

The present principles are not limited to the illustrative example and may be employed with other circuit breaker types. The functions of the various elements shown in the figures can be provided through the use of dedicated hardware as well as equivalent hardware capable of performing the same or similar functions. Additionally, it is intended that such equivalents include both currently known equivalents as well as equivalents developed in the future (i.e., any elements developed that perform the same function, regardless of structure).

Figure 1:
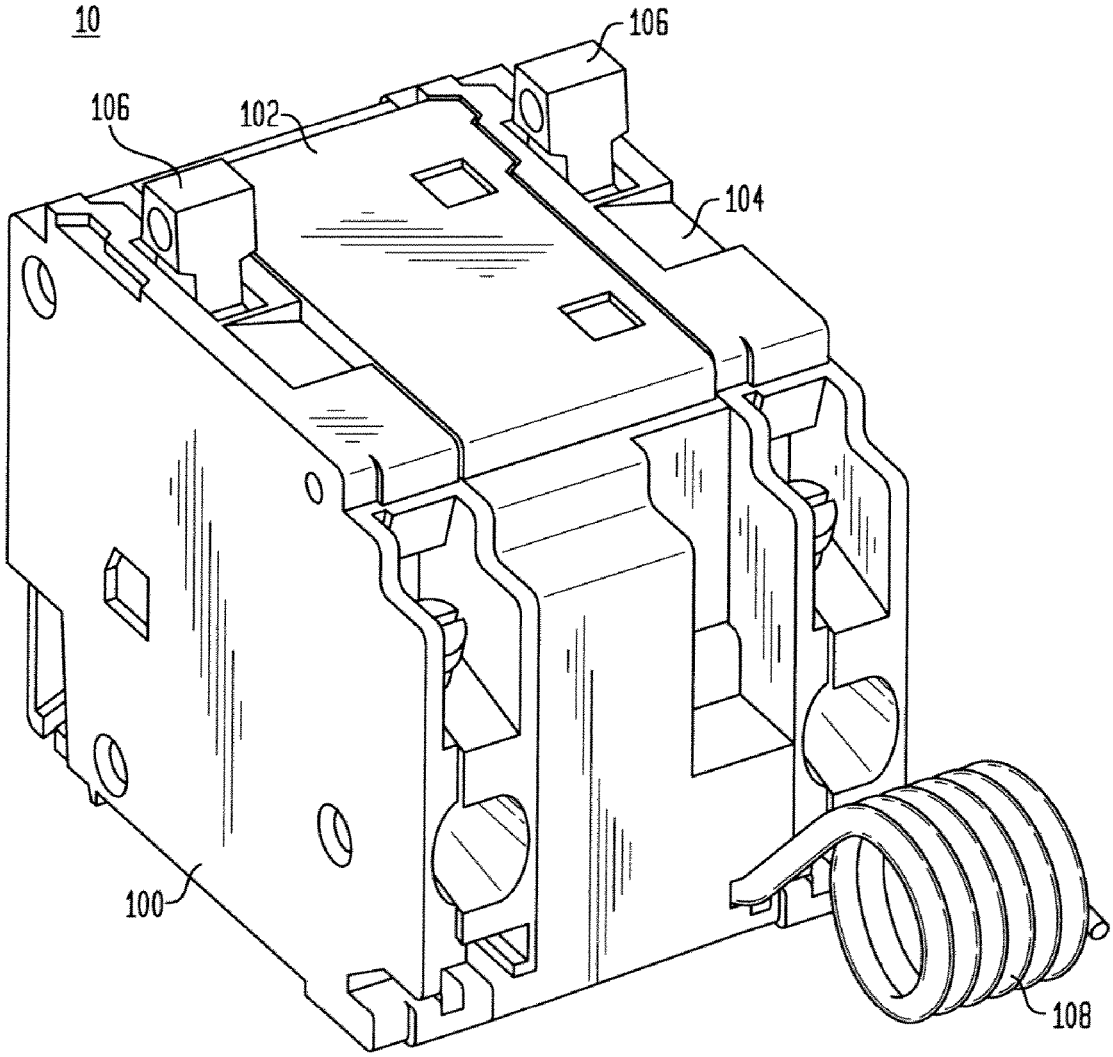
FIG. 1 is a perspective view of a multi-pole circuit breaker in accordance with one illustrative embodiment.

Referring now in specific detail to the drawings in which like reference numerals identify similar or identical elements throughout the several views, and initially to FIG. 1, a multi-pole circuit breaker 10 is illustratively shown. Circuit breaker 10 includes three modules. Outer modules 100 and 104 include similar mechanisms configured to trip under current surges or overload currents. These components may include fixed contacts, moveable contacts, moveable arms or poles which cause a breaker in a circuit between the fixed and moveable contacts and any other mechanical or electrical components which may be employed in a circuit breaker. Since such components may vary and may be known, further description is omitted for simplicity.

Circuit breaker 10 includes a center module 102 that includes electronics or electrical components employed in tripping the circuit breaker 10 during operation. The outer modules 100 and 104 include handles 106 employed in manually tripping the breaker 10 or resetting the breaker 10 after a trip. Since the breaker 10 is a multi-pole breaker, two handles 106 are shown. It should be understood that any number of modules 100 or 104 may be employed and may be configured in accordance with the present principles to trip simultaneously. A coil of wire 108 is shown for connecting the breaker 10 during installation.

Figure 2:
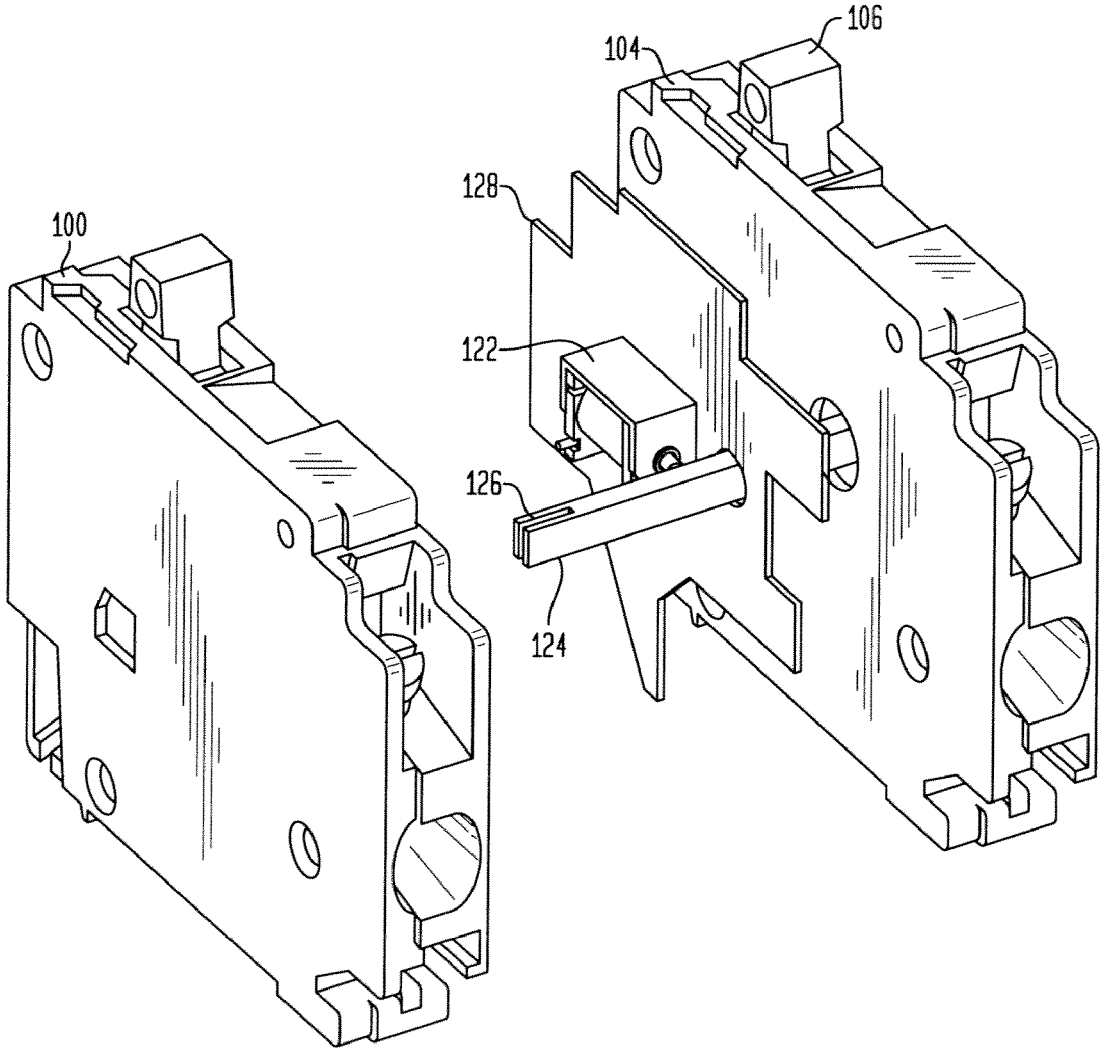
FIG. 2 is a perspective view of the multi-pole circuit breaker of FIG. 1 with a center module housing removed and one side of a beam for connecting armatures shown disassembled in accordance with one illustrative embodiment.
Figure 3:
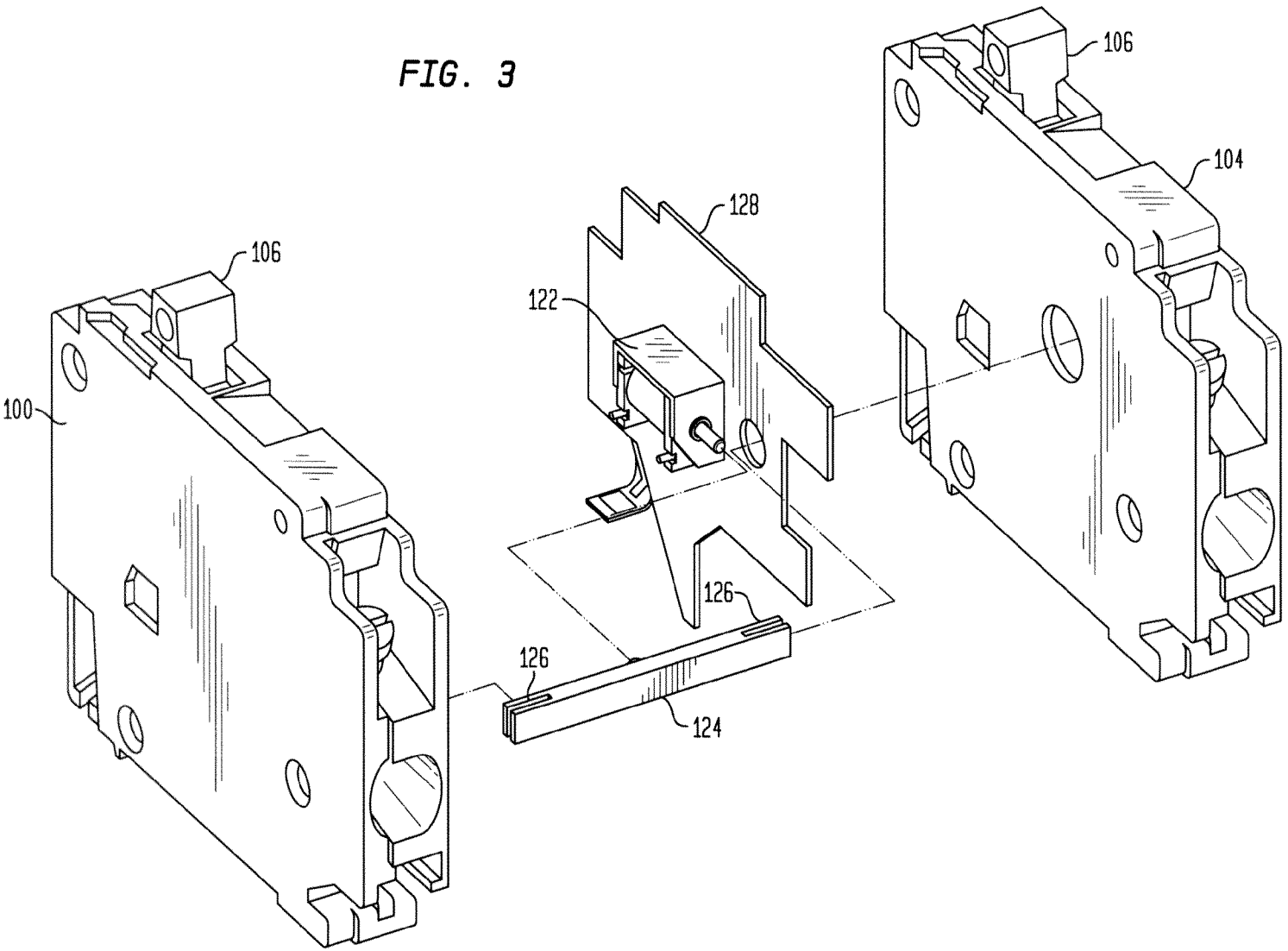
FIG. 3 is a perspective view of the multi-pole circuit breaker of FIG. 2 with the center module housing removed and both sides of the beam for connecting armatures shown disassembled in accordance with one illustrative embodiment.

Referring to FIGS. 2 and 3, a three modular type assembly is shown, with the outer modules 100 and 104 including thermal and magnetic operating mechanisms. A housing for the center module 102 is removed to show a magnetic solenoid 122 that will mechanically trip poles of the outer module 100 and 104 simultaneously. This is accomplished by a solenoid beam 124, attached directly to the solenoid 122 in the center module 102. Ends 126 of the beam 124 extend into the outer poles and attach to armatures (not shown).

FIG. 2 shows one end 126 assembled into module 104 and the other end 126 separated from module 100. In FIG. 3, the solenoid 122, beam 124 and board 128 are shown detached.

In one illustrative embodiment, the solenoid beam 124 of the center module 102 with electronics board 128 is press fit onto the solenoid 122, and then press fit into armatures (not shown) in each outer pole 100 and 104 thus linking the armatures together. Other attachment types may also be employed. In this design, there is illustratively only one magnetically latching solenoid 122 for both armatures located in the outer modules 100 and 104. Two or more solenoids 122 may be employed as well. The solenoid 122 is located in the center pole module 102 that is sandwiched between the two outer modules 100 and 104. The solenoid beam 124 is used in the center compartment and is attached directly to the solenoid 122.

Figure 4:
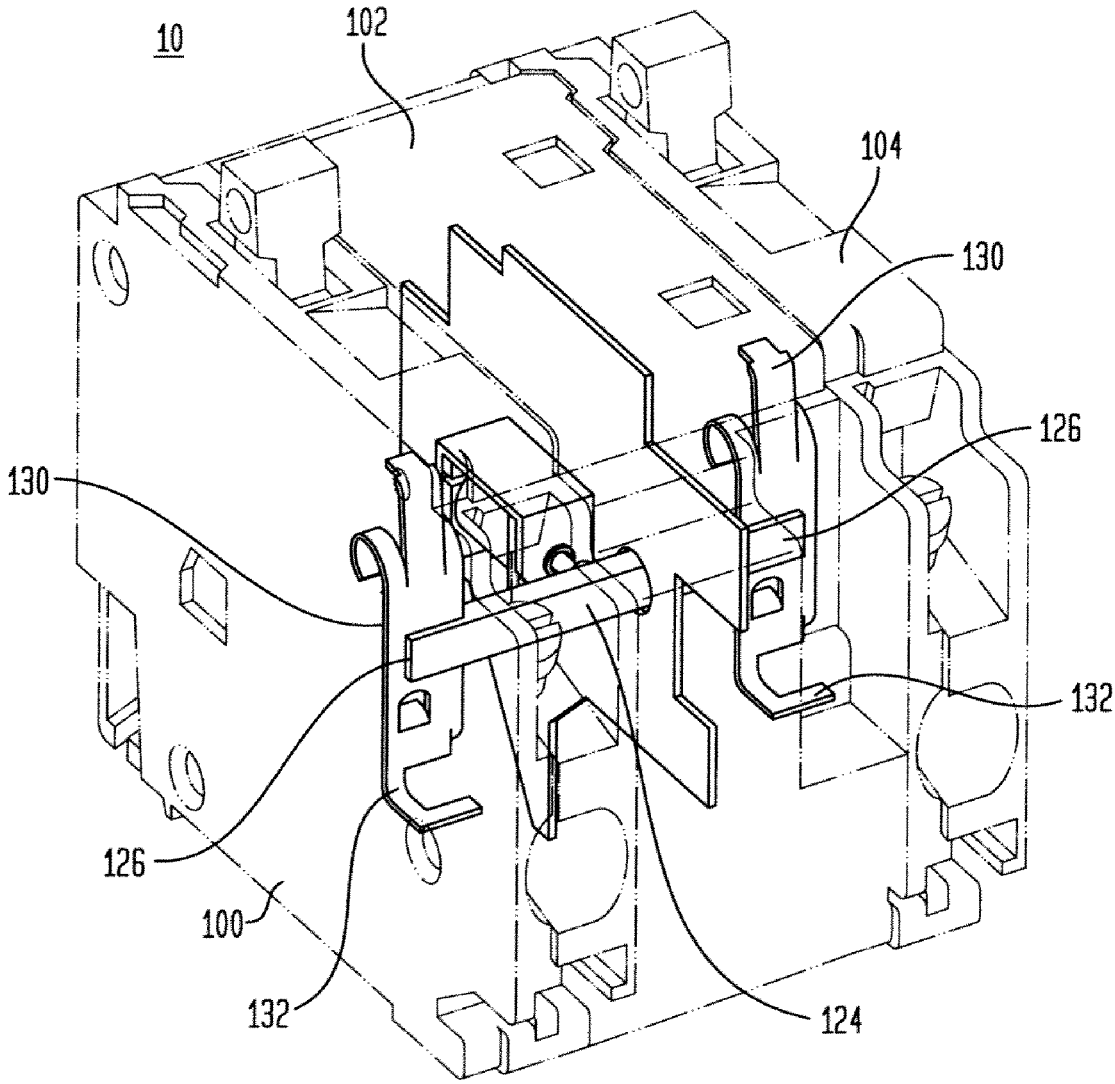
FIG. 4 is a perspective view of the multi-pole circuit breaker of FIG. 1 showing the housings and internal components in phantom and further showing the beam connecting armatures in accordance with one illustrative embodiment.
Figure 7:
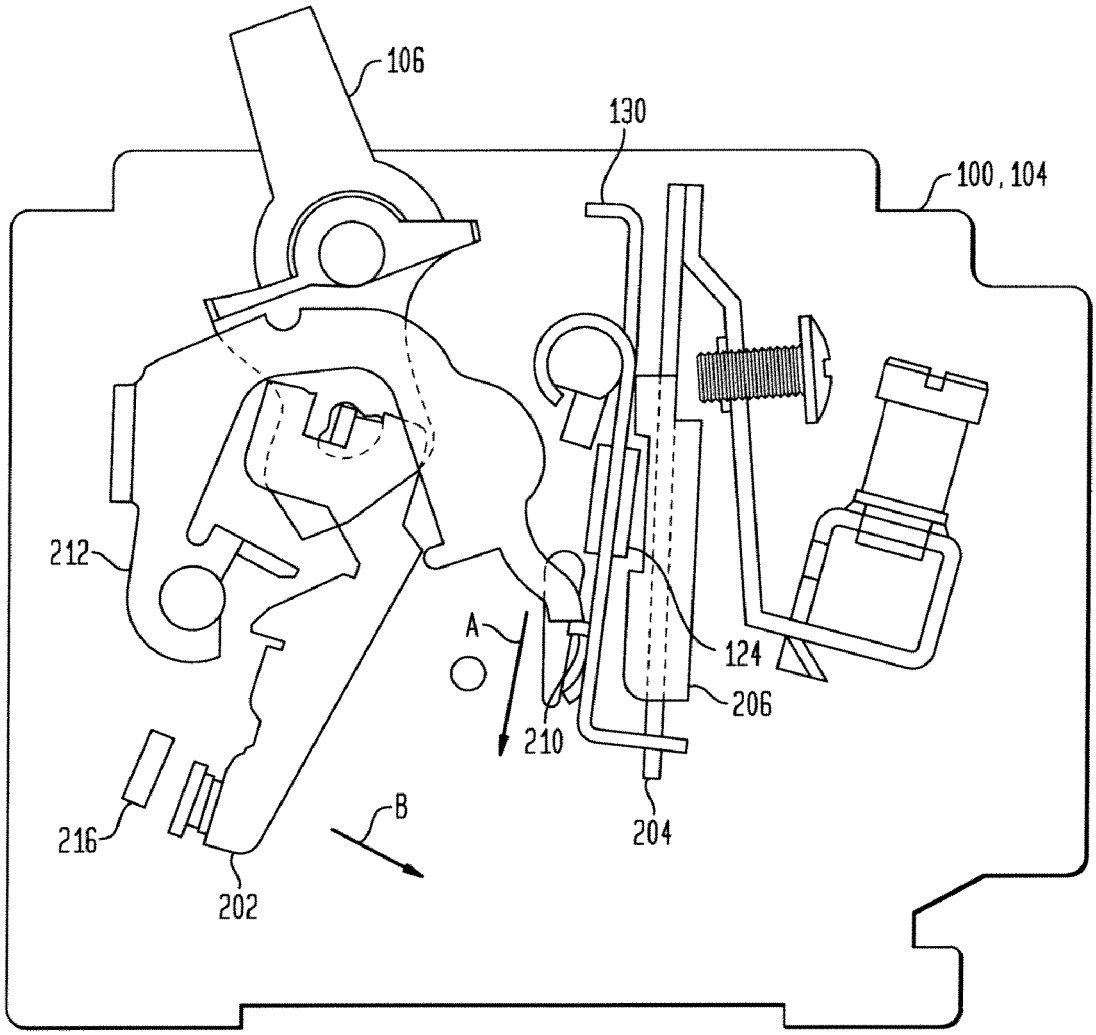
FIG. 7 is a side view illustratively showing an armature connected to the beam and configured to release a cradle and thereby trip a breaker in accordance with one illustrative embodiment.

Referring to FIG. 4, a perspective view of breaker 10 is rendered transparent to permit visualization of armatures 130 within modules 100 and 104. The beam 124 prevents tilt between the armatures 130, and the beam 124 is linked to the armatures 130 included in the outer poles 100 and 104 preferably by a press fit. An end 132 of the "2" or "Z" shaped rods serves as a wrist pin that ties outer pole solenoids, if present, and connects to a bimetal or magnetic yoke assembly (FIG. 7). The solenoid 122 of the center module 102 is linked to the solenoid beam 124 preferably by a press fit. Since the solenoid 122 and the armatures 130 in the outer poles or modules 100 and 104 are all linked together, all poles (100 and 1041 are tripped simultaneously.

Another advantage of the configuration of breaker 10 is that it eliminates the need for a second magnetically latching solenoid since the center pole or module 102 employs the solenoid beam 124. The breaker configuration also eliminates the need for a separate trip bar.

Figure 5:
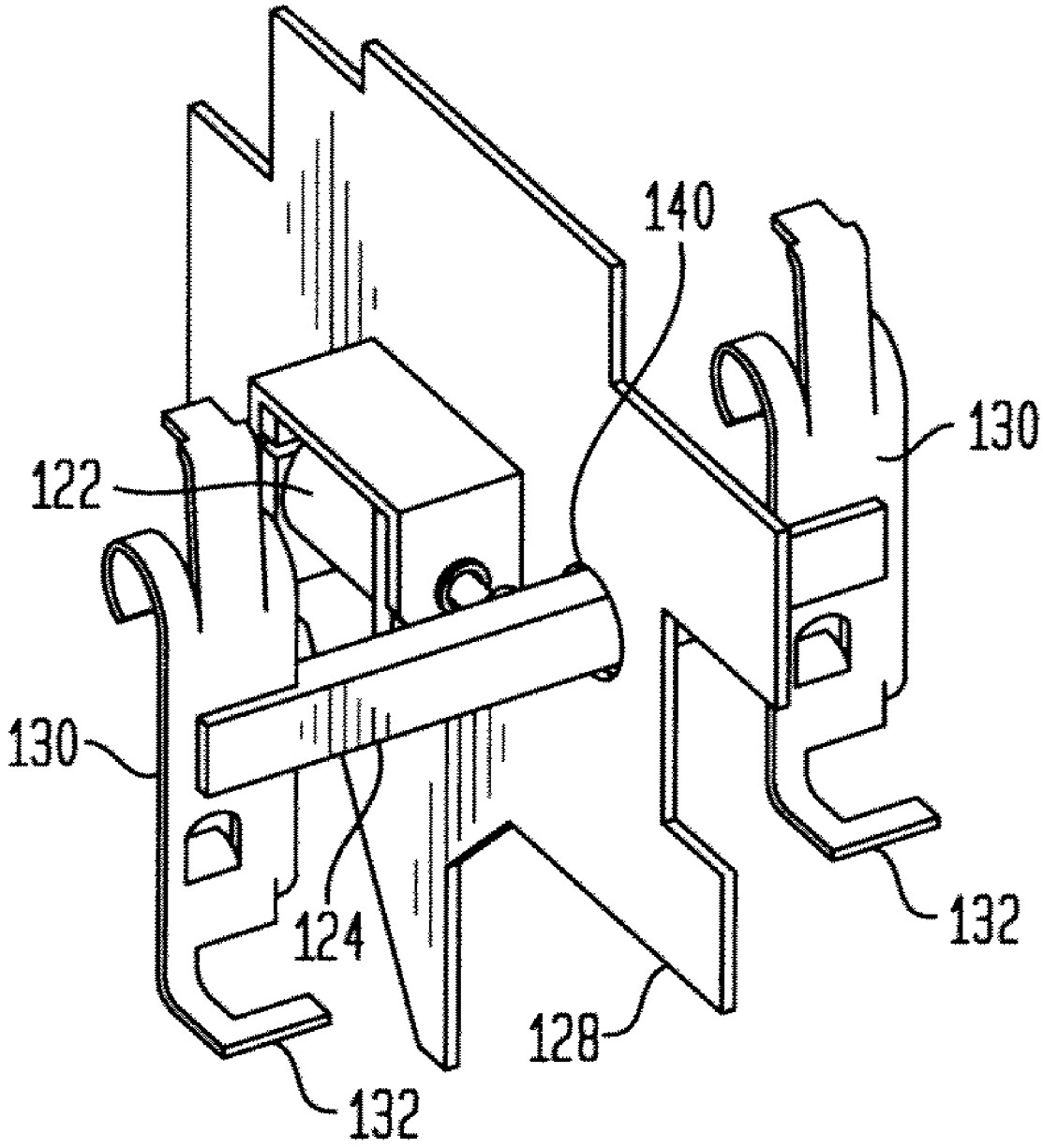
FIG. 5 is a perspective view illustratively showing armatures connected to the beam and configured to be displaced by a solenoid in accordance with one illustrative embodiment.

Referring to FIG. 5, armatures 130 are illustratively shown connected by beam 124, where the beam passes through the board 128. The solenoid 122 is powered or energized and controlled through the board 128 which is preferably a printed wiring board or PCB. An opening 140 in the board 128 for the beam 124 is small in size since the PCB 128 will only need to provide a small opening for the beam 124 to travel.

Figure 6:
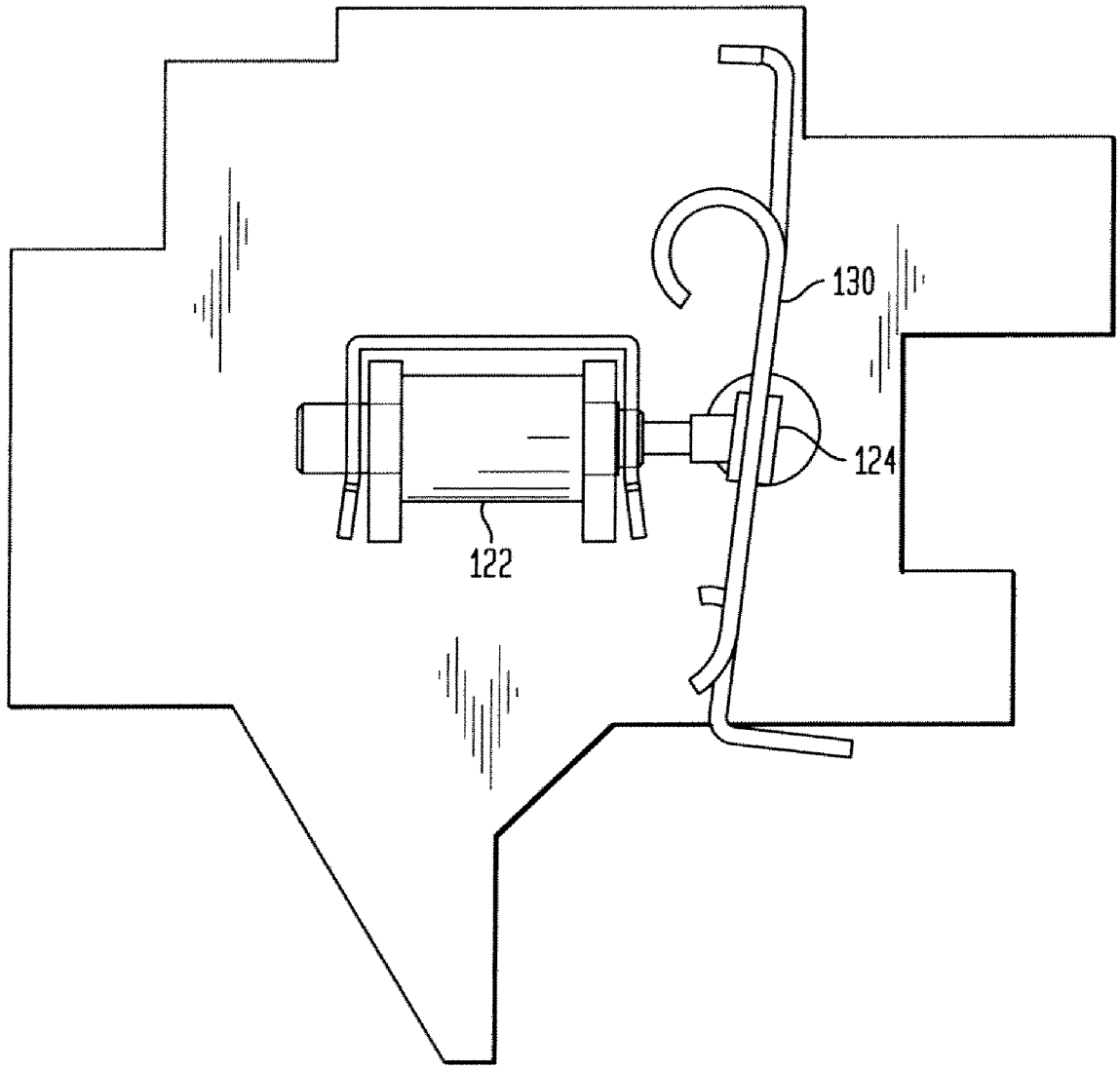
FIG. 6 is a side view illustratively showing armatures connected to the beam and configured to be displaced by a solenoid in accordance with the illustrative embodiment shown in FIG. 5.

Referring to FIG. 6, a side view of the solenoid 122 and the armatures 130 is illustratively shown. The outer modules 100 and 104 include the thermal and magnetic operating mechanisms while the center compartment 102 (FIG. 1) includes the magnetic solenoid 122 that will mechanically trip armatures 130 of the outer poles simultaneously. The solenoid beam 124 is attached directly to the solenoid 122, where each end of the beam 124 extends into the outer poles and attaches to the armatures 130.

Referring to FIG. 7, a diagram showing the interaction between a moveable blade or moveable arm 202 of outer modules 100 and 104 and an armature 130 is illustratively depicted. The solenoid 122 (FIG. 63 is activated by electronic circuitry. Each mechanical pole can be tripped with a bimetal 204 or a magnetic construction 206, which handle surges and overload conditions in outer modules 100 and 104. Residential circuit breakers are typically designed with a bimetal 204 and magnetic yoke assembly 206 to mechanically detect when an overload or instantaneous condition exists. When either of these conditions exists, armature 130 is rotated by the bending of the bimetal 204 or by the magnetic force generated by the yoke assembly 206. As the armature 130 rotates, the mechanism pole de-latches and trips the mechanism, thus opening a circuit.

In the illustrative embodiment shown, electronics in the outer modules 100 and 104 monitor the current going through each pole. The solenoid 122 (FIG. 6) is activated when one pole no longer has current or when an arc fault has been detected on either pole. Once the solenoid 122 has been triggered, the solenoid 122 rotates the beam 124 that is connected to both armatures 130 (See FIG. 5). This permits a notch 210 on armature 130 to move away from a cradle 212. The cradle 212 rotates passed notch 210 (in the direction of arrow "A"). This, in turn, causes the moveable blade 202 to trip and move away from a stationary or fixed contact 216 in the direction of arrow "B" to cause an open circuit. Since the outer modules 100 and 104 employ armatures 130 and beam 124, this ensures that both mechanical poles have been tripped together.

Having described preferred embodiments for multi-pole armature interlock for circuit breakers which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A multi-pole circuit breaker, comprising: at least two breaker modules comprising circuit breakers therein, the circuit breakers comprising a moveable arm configured to connect and disconnect contacts therein, the at least two modules comprising armatures are connectable to the moveable arms of each of the at least two modules; and a center module connecting the at least two modules, the center module comprising an actuator mounted and energized on a circuit board, the circuit board having a hole, and a beam positioned through the hole of the circuit board, the beam connected to each armature of the at least two modules and engageable with the actuator, wherein under a trip condition the actuator contacts the beam and displaces the beam to simultaneously trip the at least two modules using the armatures.

2. The breaker as recited in claim 1, wherein the printed circuit board powers and controls the actuator.

3. The breaker as recited in claim 1, wherein the actuator comprises two or more solenoids to displace the beam and simultaneously trip the two breaker modules.

4. The breaker as recited in claim 1, wherein the actuator comprises a solenoid having a solenoid plunger that displaces the beam to simultaneously trip the at least two modules.

5. The breaker as recited in claim 4, wherein the solenoid plunger is press fit into the beam.

6. The breaker as recited in claim 1, wherein the beam is press fit into the armatures.

7. The breaker as recited in claim 1, further comprising additional breaker modules, each being trippable in accordance with the center module.

8. A multi-pole circuit breaker, comprising: two breaker modules, each comprising a circuit breaker therein, each circuit breaker comprising a moveable arm configured to connect and disconnect contacts therein; an armature mounted within each of the two breaker modules, the armatures being connectable to the moveable arms of each of the respective two breaker modules such that upon moving the armatures the moveable arm is caused to trip to create an open circuit; a center module connecting the two breaker modules, the center module comprising a solenoid mounted and energized on a circuit board, the circuit board having a hole; and a beam positioned through the hole of the circuit board and extending into the two breaker modules, the beam connected to the armatures, the solenoid comprising a plunger that under a trip condition the solenoid displaces the beam to simultaneously trip the two breaker modules using the armatures.

9. The breaker as recited in claim 8, wherein breaker comprises a second solenoid to simultaneously trip the two breaker modules.

10. The breaker as recited in claim 8, wherein the actuator comprises two or more solenoids to displace the beam and simultaneously trip the two breaker modules.

11. The breaker as recited in claim 8, wherein the solenoid displaces the beam when at least one of the two breaker modules is tripped.

12. The breaker as recited in claim 11, wherein the plunger is press fit into the beam.

13. The breaker as recited in claim 8, wherein the beam is press fit into the armatures.

14. A method for simultaneously tripping a multi-pole circuit breaker, comprising: providing at least two breaker modules comprising circuit breakers therein, the circuit breakers comprising a moveable arm configured to connect and disconnect contacts therein, the at least two modules comprising armatures connectable to the moveable arms of each of the at least two modules; and a center module connecting the at least two modules, the center module comprising an actuator mounted and energized on a circuit board, the circuit board having a hole, and a beam positioned through the hole of the circuit board, the beam connected to each armature of the at least two modules beam and engageable with the actuator; detecting a trip condition in at least one of the at least two breaker modules; and energizing the actuator under the trip condition to contact the beam and displace the beam to simultaneously trip the at least two modules using the armatures.

15. The method as recited in claim 14, wherein detecting a trip condition comprises detecting the trip condition using an electronic circuit.

16. The method as recited in claim 14, wherein the actuator comprises a solenoid.

17. The method as recited in claim 14, wherein the actuator comprises two or more solenoids.

* * * * *